US005666787A

United States Patent [19]

Young et al.

[11] Patent Number: 5,666,787

[45] Date of Patent: *Sep. 16, 1997

[54] DISPENSING PACKAGE FOR DISCRETE STAGE COMPRESSED DIAPERS COMPRESSED DIAPERS THEREFOR, AND METHOD OF DISPENSING SUCH DIAPERS

[75] Inventors: Mark Douglas Young, West Chester; John Paul Erspamer, Cincinnati; Mark Edwin Forry, Hamilton; Charles John Berg, Jr., Cincinnati, all of Ohio

[73] Assignee: The Proctor & Gamble Company, Cincinnati, Ohio

[ * ] Notice: The term of this patent shall not extend beyond the expiration date of Pat. No. 5,507,130.

[21] Appl. No.: 684,165

[22] Filed: Jul. 19, 1996

Related U.S. Application Data

[63] Continuation of Ser. No. 603,140, Feb. 20, 1996, which is a continuation of Ser. No. 458,958, Jun. 2, 1995, Pat. No. 5,507,130.

[51] Int. Cl.[6] ..... B65B 1/24

[52] U.S. Cl. ..... 53/438; 53/399; 53/436

[58] Field of Search ..... 53/436, 438, 530, 53/528, 399, 449; 221/48, 50; 206/361, 362, 440, 494

[56] References Cited

U.S. PATENT DOCUMENTS

| | | | |
|---|---|---|---|
| 3,007,605 | 11/1961 | Donovan | 221/47 |
| 3,021,002 | 2/1962 | Guyer | 206/57 |
| 3,172,563 | 3/1965 | Harwood | 221/48 |
| 3,172,564 | 3/1965 | Enloe et al. | 221/48 |
| 3,197,062 | 7/1965 | Day et al. | 221/48 |
| 3,207,361 | 9/1965 | Marcalus | 53/438 |
| 3,209,941 | 10/1965 | Krake | 221/48 |
| 3,369,700 | 2/1968 | Nelson | 221/63 |
| 3,451,185 | 6/1969 | Tezuka | 53/438 |
| 3,576,243 | 4/1971 | Trunick | 221/63 |
| 3,679,094 | 7/1972 | Nissen et al. | 221/50 |
| 3,679,095 | 7/1972 | Nissen et al. | 221/50 |
| 3,881,632 | 5/1975 | Early et al. | 221/50 |
| 4,162,603 | 7/1979 | Stromberg | 53/438 |
| 4,458,810 | 7/1984 | Mahoney | 206/210 |
| 4,623,074 | 11/1986 | Dearwester | 221/48 |
| 4,751,807 | 6/1988 | Couterier | 53/530 |
| 4,757,757 | 7/1988 | Johanson | 53/530 |
| 4,778,057 | 10/1988 | Allen et al. | 206/602 |
| 4,859,518 | 8/1989 | Schutz | 428/126 |
| 5,022,216 | 6/1991 | Muckenfuhs et al. | 53/438 |
| 5,027,582 | 7/1991 | Dearwester | 53/399 |
| 5,076,466 | 12/1991 | Petterson et al. | 221/46 |
| 5,118,554 | 6/1992 | Chan et al. | 428/126 |
| 5,150,561 | 9/1992 | Muckenfuhs | 53/438 |
| 5,309,828 | 5/1994 | Merry | 53/438 |

*Primary Examiner*—John Sipos
*Assistant Examiner*—Ed Tolan
*Attorney, Agent, or Firm*—Larry L. Huston; E. Kelly Linman; Jacobus C. Rasser

[57] ABSTRACT

A tissue package comprising a plurality of tissues and a dispensing package. The plurality of tissues is compressed in two discrete stages, each of which stage can be released independently from the other. The first stage of compression is less than the second stage compression. The user releases the second stage of compression, whereby the tissues can expand up to the first stage of compression. The user releases the first stage of compression just before installing the plurality of tissues into a dispensing package or dispenses the tissues through a restraint while they are held in the first stage compression.

5 Claims, 4 Drawing Sheets

DISPENSING PACKAGE FOR DISCRETE STAGE COMPRESSED DIAPERS COMPRESSED DIAPERS THEREFOR, AND METHOD OF DISPENSING SUCH DIAPERS

This is a continuation of application Ser. No. 08/603,140, filed Feb. 20, 1996, which is a continuation application Ser. No. 08/458,958, filed on Jun. 2, 1995, now U.S. Pat. No. 5,507,130.

FIELD OF THE INVENTION

This invention relates to a tissue package comprising tissues and a dispensing package. More particularly, this invention relates to compressed packaging of such tissues.

BACKGROUND OF THE INVENTION

Tissues are well known in the art. Tissues, such as facial tissue are commonly used for blowing one's nose, cleaning tasks, etc. Tissues can also be used as paper towels for wiping, cleanup tasks, etc. Tissues, and their packaging, must be inexpensive and disposable, to be widely consumer accepted. Tissues may be supplied dry, with lotion, or moistened. Such tissues are typically generally rectangular in shape and supplied in discrete sheets. Tissues are typically supplied in and/or dispensed from a generally parallelepipedly shaped dispensing package. The dispensing package has an opening, typically at the top or a side, through which the times are removed by the user.

Early dispensing packages were of the "reach-in" type. Using a reach-in dispensing package, the user had to insert his or her fingers through the dispensing opening, grasp a tissue, and pull it out through the dispensing opening. Examples of reach-in dispensing packages, and improvements thereto, can be found in U.S. Pat. Nos. 3,021,002 issued Feb. 13, 1962 to Guyer, commonly assigned U.S. Pat. No. 3,576,243 issued Apr. 27, 1971 to Trunick; and U.S. Pat. No. 4,458,810 issued Jul. 10, 1984 to Mahoney.

Over time, the desire for increased convenience led to a sequential or pop-up dispensing packages. In "pop-up" dispensing package, a tissue usually extends through the dispensing opening to an elevation above that of the dispensing package. The user simply grasps the exposed portion of the tissue, without the necessity of inserting fingers through the dispensing opening. In pop-up dispensing, each tissue has a leading portion which is first to pass through the dispensing opening, and a trailing portion which later passes through the dispensing opening. Typically the trailing portion of a first tissue to be dispensed overlaps the leading portion of the next tissue to be dispensed. The overlap is measured generally parallel to the direction of withdrawal of the tissues through the dispensing opening. The overlap is usually, but not necessarily, the same for each tissue and constant throughout the width of each tissue. As the first tissue is withdrawn by the user, the leading portion of the next tissue is pulled through the opening, for later dispensing.

Typically the sequential withdrawal of the succeeding tissue through the dispensing opening occurs due to interfolding of adjacent tissues. The tissues are folded against one another in a variety of configurations, so that the friction of the trailing portion of the withdrawn sheet against the succeeding sheet pulls the leading portion of the succeeding sheet through the dispensing opening. Examples of various interfolding arrangements are found in U.S. Pat. No. 3,007,605 issued Nov. 7, 1961 to Donovan; U.S. Pat. No. 3,172,563 issued Mar. 9, 1965 to Harwood; U.S. Pat. Nos. 3,679,094 and 3,679,095 both issued Jul. 25, 1972 to Nissen et al; commonly assigned U.S. Pat. No. 3,881,632 issued May 6, 1975 to Early et al; U.S. Pat. No. 4,859,518 issued Aug. 22, 1989 to Schutz; and U.S. Pat. No. 5,118,554 issued Jun. 2, 1992 to Chan et al. A commercially successful improvement is the dual mode dispensing package which allows for either pop-up or reach-in dispensing. An example is found in commonly assigned U.S. Pat. No. 4,623,074 issued Nov. 18, 1986 to Dearwester.

The tissues are generally light weight and low density. Transportation and shipping of such tissues is relatively expensive. Savings, which can be passed on to the consumer, can be realized by compressing such tissues. However, there has been little success in the art, to date, in compressing facial tissues or other tissues supplied in discrete sheets.

In contrast, the toilet tissue art has recognized at least some success in compressing toilet tissue. This success is primarily due to the deformable hollow core about which the toilet tissue is wound. The hollow core is compressed until the opposite sides touch and creases appear in the core at diametrically opposed vertices. The tissue is then shipped to the consumer in this fashion, who later rerounds the core as needed to be inserted upon a common spindle in the bathroom. An example of such an attempt is illustrated by commonly assigned U.S. Pat. No. 5,027,582 issued Jul. 2, 1991 to Dearwester, which patent is incorporated herein by reference for the purpose of showing a suitable dispensing package for the present invention.

However, facial tissues not having the deformable hollow core are not susceptible to this means of compressive packaging. Furthermore, facial tissues are commonly contained and shipped within the package from which they are later dispensed, rather than inserted around a dispensing apparatus, such as a spindle.

Complicating the situation is the fragile nature of facial tissues. Facial tissues generally have a relatively low tensile strength, and cannot be dispensed from a package containing more facial tissues than the package was intended to hold. Indeed, tearing of the first few sheets of tissue is a common consumer complaint, even in packages which do not contain compressively packaged tissues.

Attempts have been made in the art to compress facial tissues or to supply facial tissues in multiple dispensing packages. For example, one attempt in the art illustrated by U.S. Pat. No. 3,197,062 issued Jul. 27, 1965 to Day et al. discloses an expandable tissue dispensing package which can house tissues maintained therein under compression prior to use. The problem with this arrangement is that the dispensing package is usually an expensive component for which the consumer must pay with each purchase. Greater economies are recognizable if the consumer reuses the dispensing package and merely inserts a new magazine of tissues to be dispensed into the reusable package. Furthermore, not reshipping the dispensing package furthers the overall goal of saving to transportation and warehousing costs. For aesthetic reasons, may consumers use a permanent package, comprising a shell or facade made of wood, decorative plastic, etc., which they place over the package in which the tissues were purchased.

One attempt in the art to provide a refillable dispensing package is illustrated in U.S. Pat. No. 5,076,466 issued Dec. 31, 1991 to Petterson et al. This attempt discloses a dispenser for sheet products and having a complex apparatus to prevent overfilling of the dispenser. However, the consumer must again pay for the anti-overfill mechanism.

Another attempt in the art provided the consumer with two clips of tissues split into two halves is illustrated by U.S.

Pat. No. 4,778,057 issued Oct. 18, 1988 to Allen et al. However, this attempt does little more than to provide two packages joined together. There is no attempt to provide any savings to the consumer by compressing the tissues.

As can be seen from the foregoing attempts in the art, what is needed is method of providing consumers compressed facial tissues. What is further needed is a way to reuse inexpensive packages for dispensing compressed facial tissues. Finally, what is needed is a way to achieve economies of transportation with compressed tissues and still load the tissues into a dispensing package without entailing undue complexity, or tearing of the tissues upon dispensing.

SUMMARY OF THE INVENTION

The invention comprises a plurality of tissues adapted to be disposed in a dispensing package. The tissues are compressed in two discrete stages, a first stage and a second stage. The tissues can be released from the second stage of compression, then optionally later released from the first stage of compression. The amount of compression imparted at the first stage of compression is less than the amount of compression imparted at the second stage of compression. The tissues have a free height taken in the direction of the compression, whereby in the first stage of compression the tissues are compressed to a first stage compression height which is less than the free height. The second stage of compression further compresses the tissues to a second stage compression height which is less than the first stage compression height. The times are independently releasable from the second stage of compression and optionally from the first stage of compression in turn, by a second stage release mechanism and and a first stage release mechanism, respectively. The tissues return to a height greater than the second stage compression height when the second stage of compression is released.

DETAILED DESCRIPTION OF THE INVENTION

Figure 1:
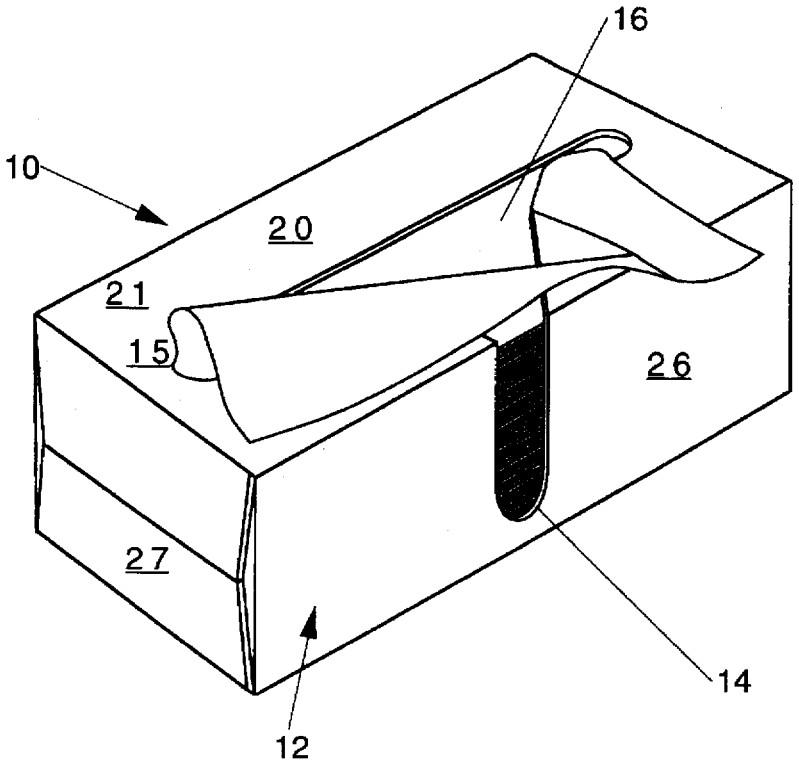
FIG. 1 is a perspective view of a dispensing package and tissues according to the present invention.

Referring to FIG. 1, the tissue package 10 according to the present invention comprises a dispensing package 12 and releasably attached tissues 14 in combination. The dispensing package 12 may have walls and be generally parallelepipedly shaped. The dispensing package 12 preferably has at least one generally planar wall 15 with a dispensing opening 16 therein. A plurality of tissues 14 are disposed in the dispensing package 12.

Examining the dispensing package 12 in more detail, it may have separate walls. The walls preferably define a top 21, a bottom, front and back sides 26, and left and right sides 27. Preferably the dispensing opening 16 intercepts the top 21, which can be coincident the aforementioned generally planar wall 15. Alternatively, the dispensing package 12 may be generally flaccid, and not have a planar or rigid wall.

The height of the dispensing package 12 is typically an issue only if pop-up dispensing is desired and the breaking strength of the releasable attachment means is overcome by the weight of the tissue 14 between the releasable attachment means and the magazine of tissues 14 therebelow. As the dispensing package 12 becomes taller in the vertical direction, and the weight of the free hanging tissue 14 increases, the dispensing opening 16 must become more restrictive to prevent the tissue 14 to be dispensed from falling back into the dispensing package 12. Furthermore, as the tissues 14 become thicker, the area of the dispensing opening 16 should increase to allow the tissues 14 to be dispensed therethrough.

The tissue package 10 according to the present invention can be either disposable or refillable. By "disposable" is meant the dispensing package 12 is intended to be discarded after the plurality of tissues 14 supplied therewith is depleted. The dispensing package 12 is not intended to be restocked with tissues 14. Likewise, each tissue 14 is discarded after use, and is not laundered, or otherwise restored. By "refillable" it meant the dispensing package 12 is or may be restocked with tissues 14 after the supply is depleted. Preferably the dispensing package 12 is refillable.

The tissue package 10 may also be lightweight. By "lightweight" it is meant the dispensing package 12 is conveniently portable and does not have dead weight specifically added thereto.

A suitable dispensing package 12 may be made in accordance with the teachings of commonly assigned U.S. Pat. No. 4,623,074 issued Nov. 18, 1986 to Dearwester, or U.S. Pat. No. 5,379,897 issued Jan. 10, 1995 to Muckenfuhs et al., which patents are incorporated herein by reference.

Suitable tissues 14 may be made according to commonly assigned U.S. Pat. No. 4,191,609 issued Mar. 4, 1980 to Trokhan, or U.S. Pat. No. 5,332,118 issued Jul. 26, 1994 to Muckenfuhs, the disclosures of which are incorporated herein by reference for the purpose of showing how to make tissues 14 suitable for use with the present invention. It is to be understood that the tissues 14 may either be wetted, or dry. One skilled in the art will recognize that the dispensing package 12 will be water impervious if the tissues 14 are wetted.

Figure 2:
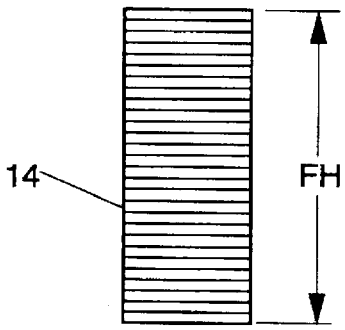
FIG. 2 is a side elevational view of a plurality of tissues according to the present invention at a free height.

Referring to FIG. 2, the plurality of tissues 14 according to the present invention has a free height FH. "Free height" is the vertical measurement, taken from a horizontal reference plane, of the plurality of tissues 14 as it lays unrestrained on the horizontal reference surface. It is to be recognized that the same size and number of tissues 14 comprising the plurality may have different free heights FH depending upon the folding pattern, the caliper of the tissues 14, interleaved pattern, etc., used to place one tissue 14 in proximity to the next tissue 14 in the plurality.

The amount of compression imparted to the plurality of tissues 14 is taken as the difference between the compressed height of the tissues 14 and the height of the tissues 14 in their previous condition, either at free height FH or at a lesser stage of compression.

Figure 3:
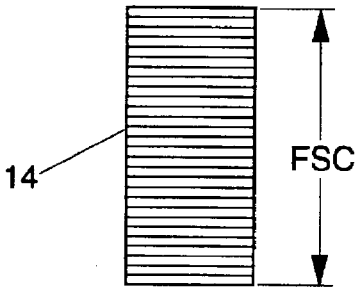
FIG. 3 is a side elevational view of the tissues of FIG. 1 having been compressed to a first stage compression height.

Referring to FIG. 3, the plurality of tissues 14 is compressed in a first direction, and held in the compressed state until a first stage restraint is secured around the plurality of tissues 14. The compressive force is then removed and the plurality of tissues 14 remains compressed at the first stage of compression.

The first stage compression may be accomplished during typical packaging processes. Thus, this compression may be advantageously accomplished with conventional equipment, and is beneficial in providing during the packaging operation. The compressive force may be provided by the packaging equipment, the first stage restraint, or combinations thereof. The second stage compression, discussed below, may be accomplished in a similar manner. The first stage compression height FSC may be from 70 to 99 percent, is preferably from 70 to 95 percent, and is more preferably from 85 to 95 percent of the free height FH, and more preferably qualitatively approximates the hysteresis resulting from the second stage of compression.

The first stage compression height FSC may be selected to approximate the height to which the plurality of tissues 14 rebounds when the second stage of compression is released. This provides a tissue package 10 to the consumer which is neat in appearance when the second stage compression is released, yet has the tissues 14 fitted in proximity to one another, such that the tissues 14 are easily dispensed. It must be kept in mind that the tissues 14 should be at less than the free height FH while in the first stage of compression, so that the tissues 14 will fit into the dispensing package 12.

The first stage restraint may have a line of weakness, or even a slit therein, through which the tissues 14 may be dispensed. The user opens the first stage restraint, partially dispenses a tissue 14 therethrough, and then inserts the plurality of tissues 14, while still restrained at the first stage of compression into the refillable dispensing package 12. Alternatively, the plurality of tissues 14 may be installed in the dispensing package 12, then partially dispensed through the first stage restraint. The tissues 14 do not rebound to the free height FH due to the hysteresis resulting from the second stage of compression. Accordingly, there should be little, if any, tearing of the tissues 14 during dispensing caused by undue compression.

Alternatively, the first stage restraint may be easily releasable by the consumer so that the plurality of tissues 14 may return to approximately its free height FH. Preferably the tissues 14 are released from the first stage of compression, and rebound to slightly less than their free height FH due to hysteresis. The hysteresis allows the tissues 14 to be placed in the refillable dispensing package 12 without tearing of the tissues 14 or compression in the dispensing package 12, which would cause tearing when dispensing occurs. It would be apparent to one skilled in the art that the first stage restraint may completely enclose the tissues 14, or only cover part of the tissues 14. Suitable release mechanisms for the first stage restraint include bands, tear tabs, frangible bonds, and vacuum seals.

Thus, under either of the two forgoing scenarios, the tissues 14 are dispensed from the dispensing package, without being in the second stage of compression. As noted above, the tissues 14 may either be released from the first stage restraint, or dispensed through the first stage restraint. It should be noted, that if the tissues 14 are dispensed through the first stage restraint rather than being released therefrom, in a less preferred embodiment, the first stage restraint may serve as the dispensing package 12. In such an execution, the consumer, rather than insert the tissues 14 and first stage restraint into the dispensing package 12, simply opens the first stage restraint and dispenses the tissues 14 therethrough.

The plurality of tissues 14 is loosely packaged by the first stage restraint. The first stage restraint comprises any packaging material which allows the plurality of tissues 14 to be compressed to a first stage compression height FSC, later compressed to a second stage compression height SSC, released back to the first stage compression height FSC, and then later released back to nearly the free height FH or an approximation thereof.

The first stage restraint may comprise a thin gauge polymeric film, such as polyethylene, a paper wrapper, a flexible thermoform material, or even a rigid material having accordion features allowing it to be compressed. A particularly preferred material is 1 mil blend of polyethylenes made by the Exxon Company.

Figure 4:
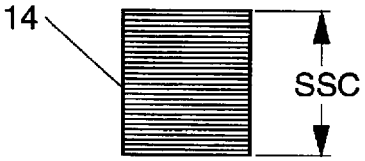
FIG. 4 is a side elevational view of the tissues of FIG. 2 having been compressed to a second stage compression height.

Referring to FIG. 4, the plurality of tissues 14, having been compressed in a first discrete stage to a first stage of compression, is then further compressed to a second stage of compression. The second stage of compression is independent of and separately releasable from the first stage of compression. The compressive force applied during the second stage of compression is applied in the same direction as the compressive force applied in the first stage of compression. The second stage compressive force is applied to both the plurality of tissues 14 and first stage restraint, the plurality of tissues 14 having already been compressed to a first stage of compression and held there by the first stage restraint.

The second stage of compression further reduces the height of the plurality of tissues 14 to a second stage compression height SSC. The second stage compression height SSC is about 25 to about 84 percent of the free height FH, and preferably about 30 to about 50 of the free height FH, so that two to three (or multiple) pluralities of tissues 14 may be warehoused and shipped in the volume of conventional tissue packages 10.

The second stage of compression is accomplished in a manner similar to the first stage. The second stage of compression preferably compresses the plurality of tissues 14 to a second stage compression height SSC which is approximately 50 percent that of the free height FH, so that the consumer may conveniently store two pluralities of tissue in the space normally occupied by one tissue package 10. After compressing the plurality of tissues to the second stage compression height SSC, the plurality is preferably secured in place by a second stage restraint.

The second stage restraint may comprise a thin gauge polymeric film, such as LDPE, a paper wrapper, a flexible thermoform material, or even a rigid material having accordion features allowing it to be compressed. A particularly preferred material is aforementioned Exxon polyethylene film. Suitable release mechanisms for the second stage restraining include bands, tear tabs, frangible bonds, and vacuum packaging.

It will be apparent to one skilled in the art or more pluralities of tissues 14, each separately compressed to a first stage of compression, may be bundled together, jointly compressed to a second stage of compression, then held in the second stage of compression with a common second stage restraint. This arrangement provides the advantage that the two of more pluralities of tissue 14 may be transported as a single unit to the consumer. The consumer then purchases the single unit comprising multiple pluralities of tissues 14. When the second stage of compression is released, each of the pluralities returns to a first stage of compression. Each plurality of tissues 14 may be retained in the first stage of compression until ready for use with the dispensing package 12.

It will further be apparent to one skilled in the art that the second stage of compression must compress the plurality of tissue 14 more than does the first stage of compression. This differential compression between the two independent stages is necessary to obtain the economies of shipping and warehousing during the period when both the first and second stages of compression occur. However, after the consumer receives the plurality of tissues 14, the second stage of compression is released, shipping and warehousing having already occurred. The consumer then needs a lesser amount of compression, as occurs during the first stage of compression. The lesser amount of compression only in events the tissues 14 from returning to their free height FH prior to being installed in the dispensing package 12 if the rebound from the second stage of compression is nearly one hundred percent. Upon release of the second stage release mechanism, preferably the tissues 14 do not return to the first stage compression height FSC, so that there is no or, at most, minimal tension applied to the first stage restraint. The first stage restraint may serve the important function of instilling the tissues 14 from dirt and contamination after being removed from the second stage restraint and holding the tissues 14 in a neat bundle until ready for dispensing by the consumer or insertion into the dispensing package 12. Thus, the first stage restraint may provide a cover and totally encapsulate the tissues 14.

Figure 5:
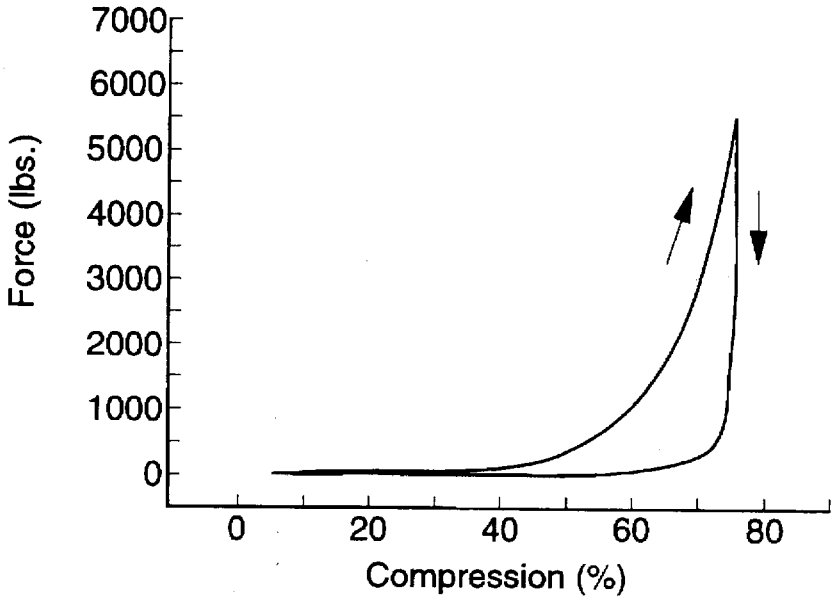
FIG. 5 is a graphical representation of the compression hysteresis behavior of commercially available tissues subjected to a first stage compression and then released.

The tissues 14 display hysteresis behavior when compressed. To demonstrate this hysteresis, three 176 count sets or purchased Puffs-Up brand tissues 14 from The Procter & Gamble Company were disposed on top of one another, without the dispensing packages 12. The tissues 14 were compressed in a tensile machine fitted with load cells to read compression force until 75 percent compression was achieved, and a first stage compression height FSC was then 60 millimeters. The compression was then released. The tensile machine crosshead traveled at 17 millimeters per second during both the compression and release cycles. The free height FH was 240 millimeters. The compression relaxation cycle for this experiment is shown in FIG. 5. No second stage compression was performed.

Figure 6:
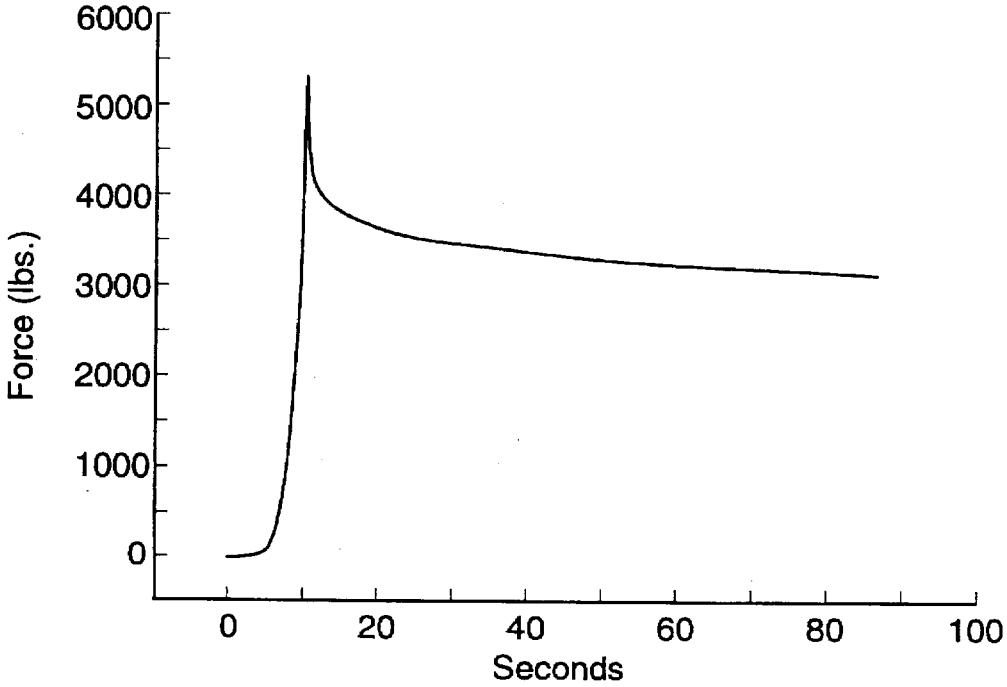
FIG. 6 is a graphical representation of the decay of the force exerted by the times of FIG. 5 when compressed to a first stage compression.

In the next experiment, instead of immediately allowing the relaxation cycle to occur, as illustrated in FIG. 6, the products wee compressed to 75 percent compression then held. The peak force at 75 percent compression exponentially decays approximately 37 percent over 60 seconds. The equilibrium peak decay force occurs at about 39 percent compression. The decay of the force necessary to achieve the 75 percent compression noted above as a function of time is illustrated in FIG. 6.

Taken together, the hysteresis and decay properties, as illustrated in FIGS. 5–6, are believed to be a function of the compression rate. Factors such as the rate of air evacuation from the plurality of tissues 14 and the rate at which surface fibers of the fiber structures within the tissue 14 reorient to a lower energy position will affect both the compression response and hence, the resulting decay.

Using a first stage and a second stage compression, it is readily apparent that higher compression forces will be necessary to achieve second stage compression. For the above-identified samples of Puffs-Up brand tissues, compression to a first stage compression height FSC of 72 percent of the free height FH requires just 20 pounds of compression force.

A subsequent second stage compression height SSC of 25 percent of the free height FH requires 4,000 to 6,000 pounds force for the conditions cited above. Without limiting the present invention by theory, the first stage compression is believed to be affected by 1) squeezing the spaces between folded halves of the tissues 14, and 2) evacuating the air therebetween. Such spaces occur due to not having perfectly flat lay down of the tissues 14 during manufacturing, nor perfect folds which are aligned on top of each other.

The second stage compression is believed to be affected by at least three factors: 1) compression of the space between the two plies making up an individual tissue 14, 2) compression of any fibers projecting outwardly from the surface of a tissue 14, and 3) compressing the fiber structure within the body of the tissue 14. It will be recognized by one skilled in the art that the factors affecting the first stage compression and second stage compression are not necessarily discrete and separated. A transition between the factors affecting the first stage compression and the factors affecting the second stage compression may occur, particularly as higher first stage compression are encountered.

Figure 7:
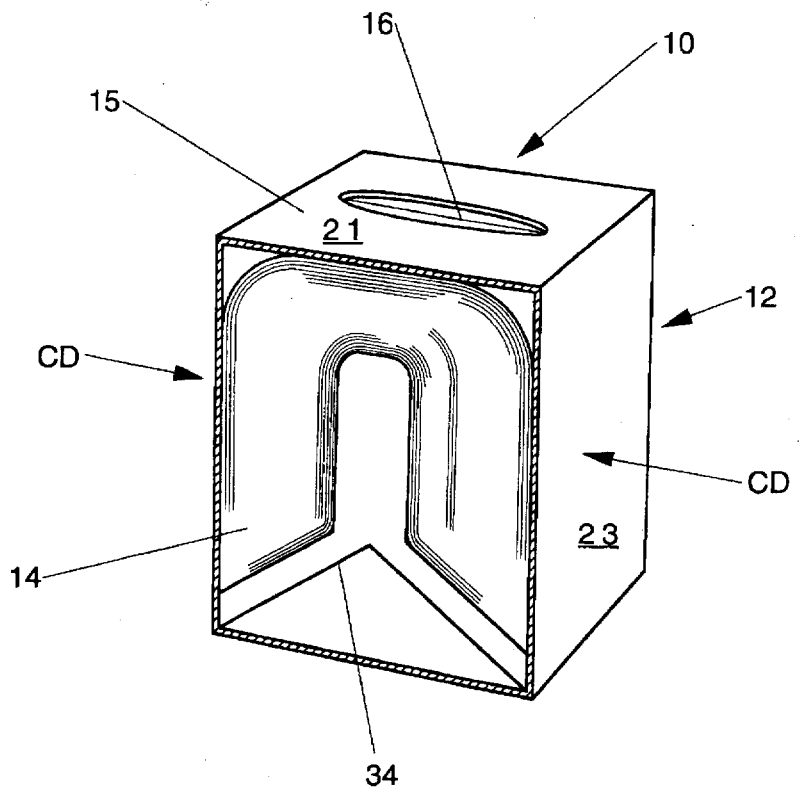
FIG. 7 is a sectional perspective view of a plurality of tissues U-folded over a support member.

Referring to FIG. 7, in an alternative embodiment, the tissues 14 may be U-folded and disposed on a support member 34. The plurality of tissues 14 are bi-folded about a fold axis, so that the free ends of the tissues 14 are generally opposite the fold axis. The tissues 14 may be bi-folded about an axis parallel to the machine direction or the cross machine direction. The tissues 14 may be C-folded or Z-folded prior to the bi-fold.

The optional support member 34 is disposed within the dispensing package 12 and may be Y-shaped as shown. It will be recognized by one skilled in the art that other support members 34 are feasible. For example, the dispensing package 12 may be broken into tray-like half portions forming the support member 34. Examples of such dispensing packages with the preferred support member 34, as illustrated, and the alternative support member may be found in commonly assigned U.S. Pat. No. 3,881,632 issued May 6, 1975 to Early et al.; and U.S. Pat. No. 3,209,941 issued Oct. 5, 1962 to Krake, respectively, which patents are incorporated herein by reference. Alternatively, the tissues 14 may be U-folded upon themselves without a support member 34. An example of such an arrangement of U-folded tissues 14 not having a support member 34 is disclosed in U.S. Pat. No. 3,369,700 issued Feb. 20, 1968 to Nelson, which patent is incorporated herein by reference.

The U-folded tissues 14 having the arrangement of FIG. 7 may be compressed in two discrete stages, as described above with respect to the tissues 14 of FIGS. 1–4. However, for the embodiment of FIG. 7, the first stage and second stage compressions must occur colinear with arrows CD which indicate the compression direction, and be generally transverse to the folding axis. Of course, the free height FH, first stage compression height FSC, and the second stage compression height SSC are measured parallel to the direction of arrows CD.

Figure 8:
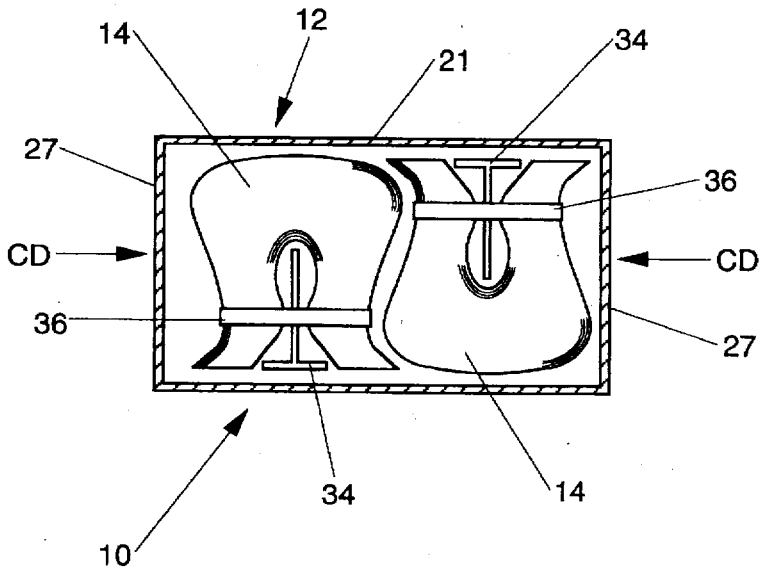
FIG. 8 is a front elevational sectional view of tissues arranged as shown in FIG. 5 when packaged for shipment in an alternating nested configuration.

Referring to FIG. 8, the U-folded tissues 14 may be disposed in an alternating nested arrangement for shipping within the dispensing package 12, as illustrated in FIG. 8. This embodiment has a T-shaped support mender 34. This arrangement has the free ends of a first plurality of tissues 14 oriented in a first direction, and the free ends of a second plurality of tissues 14 oriented in the opposite direction. This arrangement advantageously allows the blooming which inherently occurs at the central portion of the tissues 14 draped over the support member 34 to nest and occupy the space created by the blooming of the adjacent plurality of tissues 14.

Prophetically, this arrangement may be maintained in the desired position by a first stage release mechanism 36 comprising a band juxtaposed with the free ends of the tissues 14.

While FIG. 8 illustrates a dispensing package 12 having two pluralities of alternating nested tissues 14 disposed therein, one skilled in the art will recognize that multiple pluralities of tissues 14 may be disposed in the alternating nested configuration, so long as the dispensing package 12 is sized accordingly.

Figure 9:
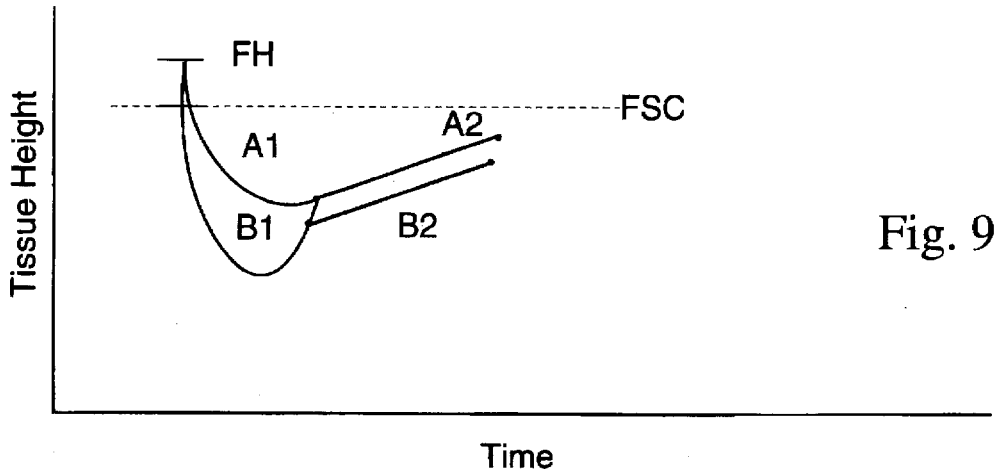
FIGS. 9–11 are graphical representations of first stage and/or second stage compressions subjected to overstroking. The height of the tissues is shown on the vertical axis. Compression is in the downward direction. Rebound is in the upward direction. Relative time is on the horizontal axis.
Figure 10:
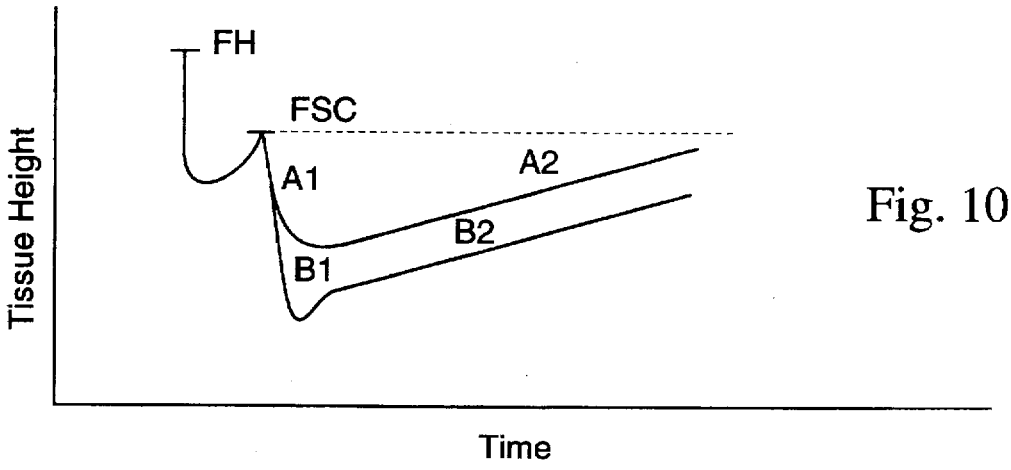
Figure 11:
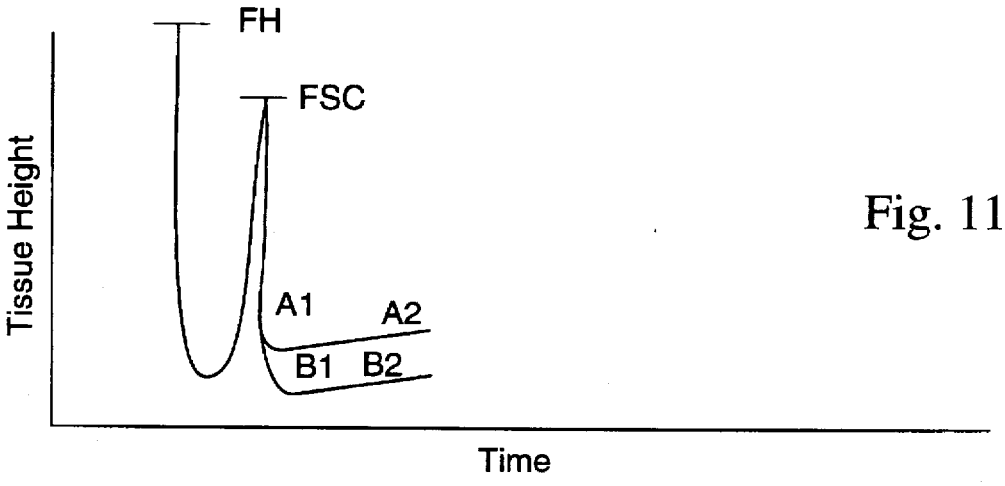

Referring to FIGS. 9–11, prophetically the plurality of tissues 14 may be compressed beyond the level at which the first stage compression height FSC is desired and the first stage restraint would be secured around the plurality of tissues 14. This is referred to as "overstroke." As used herein, overstroke refers to compressing the tissues 14 by applying compressive force, and compressing the tissues 14 to a lesser height than either the first stage compression height FSC or the second stage compression height SSC, then releasing the compression until the desired first stage or second stage compression is achieved. The tissues 14 may then be bundled at the desired first stage compression height FSC or second stage compression height SSC. It will be apparent to one skilled in the art that overstroking may occur during second stage compression as well. Overstroking the tissues 14 as described above prophetically provides the advantage that control of the rebounds from both the first stage compression and second stage compression is possible.

FIG. 9 illustrates a process wherein the second stage compression is overstroked then released somewhat. Line segments A1 and A2 show no overstroke going from the first stage compression to the second stage compression and the resulting rebound therefrom, respectively. Line segment B1 shows a second stage compression subjected to overstroke. Line segment B2 shows the resulting rebound. It is apparent to one skilled in the art that the compression from the free height FH to the first stage compression height FSC may be made to approximate the rebound from the second stage compressed height SSC with or without overstroke at the first stage compressed height FSC.

FIG. 10 illustrates an overstroke on the first stage compression and second stage compressions with and without overstroke. Line segments A1 and A2 again show no overstroke and the resulting rebound, respectively. Line segments B1 and B2 show a second stage compression subjected to overstroke and the resulting rebound therefrom.

FIG. 11 shows overstrokes on both the first and second stage compressions. FIG. 11 additionally shows a process where the first stage compression is subjected to overstroke, and the second stage compression and resulting rebound illustrated by line segments A1, A2 is subjected to overstroke and returns to the overstroke position of the first stage compression height FSC. Line segments B1 and B2 show greater overstroke and rebound, respectively. The first stage compression overstroke can equal or exceed the compression at the second stage compression, so that the tissues have a lesser height during the first stage compression overstroke than at the second stage compressed height SSC.

In alternative embodiment, prophetically the tissues 14 may be loosely wrapped at free height in the first stage restraint. The tissues 14 then may be compressed and held in the compressed condition by a second stage restraint. The tissues 14 are then shipped to the consumer in this manner. When desired, the consumer removes the second stage restraint, allowing the tissues 14 to expand to approximate the free height FH and be held in place by the first stage restraint. The user then either removes the first stage restraint from the tissues 14, or dispenses the tissues 14 through the first stage restraint. The tissues 14 and first stage restraint may be inserted into a refillable dispensing package 12 as desired.

The present invention may also be used with other compressible articles, such as diapers, sanitary napkins, gauze or cotton pads, table napkins, etc.

The present invention does not cover packages of compressed articles which are later packaged into a case under subsequent compression. The retailer or consumer removes the articles from the case, prior to releasing any first stage restraint. In this configuration, however, the second stage compression is less than the first stage compression.

What is claimed is:

1. A method of packaging diapers for later dispensing, said method comprising the steps of:

providing a plurality of diapers in a stack, said stack having a free height;

compressing said stack of diapers in a first stage of compression until a first stage compression height is attained, said first stage compression height being less than said free height;

restraining said diapers with a first stage restraint, so that said first stage of compression is maintained;

compressing said stack of diapers in a second stage of compression until a second stage compression height is attained, said second stage compression height being less than said first stage compression height; and restraining said diapers with a second stage restraint, so that said second stage of compression is maintained;

each of said first stage of compression and second stage of compression being releasable independent of the other when said first stage restraint and second stage restraint are released respectively, each of said first stage restraint and second stage restraint also being releasable independent of the other;

releasing said second stage restraint, whereby said diapers rebound to a height greater than said second stage compression height;

releasing said first stage restraint; and installing said plurality of diapers into a dispensing package.

2. A method of packaging diapers for later dispensing according to claim 1 whereby said diapers rebound to a height greater than said first stage compression height.

3. A method of packaging diapers for later dispensing, said method comprising the steps of:

providing a plurality of diapers in a stack, said stack having a free height;

compressing said stack of diapers in a first stage of compression until a first stage compression height is attained, said first stage compression height being less than said free height;

restraining said diapers with a first stage restraint, so that said first stage of compression is maintained;

compressing said stack of diapers in a second stage of compression until a second stage compression height is attained, said second stage compression height being less than said first stage compression height; and restraining said diapers with a second stage restraint, so that said second stage of compression is maintained;

each of said first stage of compression and second stage of compression being releasable independent of the other when said first stage restraint and second stage restraint are released respectively, each of said first stage restraint and second stage restraint also being releasable independent of the other;

releasing said second stage restraint, whereby said diapers rebound to a height greater than said second stage compression height;

installing said plurality of diapers and said first stage restraint in said dispensing package; and dispensing said diapers through said first stage restraint.

4. A method of packaging diapers according to claim 3, wherein said stack of diapers is compressed to a height lesser than said first stage compression height.

5. A method of packaging diapers according to claim 3, wherein said stack of diapers is compressed to a height lesser than said second stage compression height.

* * * * *

UNITED STATES PATENT AND TRADEMARK OFFICE

CERTIFICATE OF CORRECTION

PATENT NO. : 5,666,787

DATED : September 16, 1997

INVENTOR(S) : MARK DOUGLAS YOUNG et al.

It is certified that error appears in the above-identified patent and that said Letters Patent is hereby corrected as shown below:

Title Page, Assignee:, "Proctor" should read – Procter --.

Title Page, References Cited, add the following omitted reference – 4,799,350 1/89 Rias 53/399 --.

Column 1, line 19, "tissue" should read – tissues, --.

Column 1, line 29, "times" should read – tissues --.

Column 1, line 36, "Guyer," should read – Guyer; --.

Column 1, line 39, delete "a".

Column 1, line 40, after "In" insert – a --.

Column 2, line 55, "to" should read – on --.

Column 2, line 56, "may" should read – many --.

Column 3, line 6, after "needed is" insert – a --.

Column 3, line 29, "times" should read – tissues --.

Column 3, line 32, delete "and", first occurrence.

Column 3, line 51, "times" should read – tissues --.

Column 5, line 55, "would" should read – will --. (2nd occurrence)

Column 6, line 38, delete "about", second occurrence.

Column 6, line 38, after "50" insert – percent --.

Column 6, line 57, after "is" insert – the --.

Column 6, line 59, "restraining" should read – restraint --.

Column 6, line 61, after "art" insert – that two --.

Column 6, line 67, "of", first occurrence, should read – or --.

Column 7, lines 19-20, "in events" should read – prevents --.

UNITED STATES PATENT AND TRADEMARK OFFICE

CERTIFICATE OF CORRECTION

PATENT NO. : 5,666,787

DATED : September 16, 1997

INVENTOR(S) : MARK DOUGLAS YOUNG et al.

It is certified that error appears in the above-identified patent and that said Letters Patent is hereby corrected as shown below:

Column 7, line 28, "instilling" should read – insulating --.

Column 7, line 35, "176" should read – 175 --.

Column 7, line 36, "or" should read – of commercially –.

Column 7, line 50, "wee" should read – were --.

Column 7, line 61, "of" should read – or --.

Column 8, line 25, "compression" should read – compressions --.

Column 8, line 44, "1962" should read – 1965--.

Column 8, line 65, "mender" should read – member --.

Column 9, line 66, after "In" insert – an --.

Signed and Sealed this

Seventeenth Day of March, 1998

*Attest:*

*Attesting Officer*

BRUCE LEHMAN

*Commissioner of Patents and Trademarks*